US005217343A

United States Patent [19]

Bostad et al.

[11] Patent Number: 5,217,343

[45] Date of Patent: Jun. 8, 1993

[54] LIFT TRUCK CARRIAGE

[75] Inventors: Wayne Bostad, Vancouver, Wash.; Alan Johnson; Emmett Frison, both of Portland, Oreg.

[73] Assignee: Swingshift/Brudi Manufacturing, Inc., Ridgefield, Wash.

[21] Appl. No.: 985,743

[22] Filed: Dec. 4, 1992

Related U.S. Application Data

[63] Continuation of Ser. No. 691,138, Apr. 24, 1991, abandoned.

[51] Int. Cl.[5] ..... B66F 9/14

[52] U.S. Cl. ..... 414/667; 414/659

[58] Field of Search ..... 414/607, 631, 659, 663, 414/667, 671

[56] References Cited

U.S. PATENT DOCUMENTS

| | | | |
|---|---|---|---|
| 3,819,078 | 6/1974 | Walsh | 414/671 |
| 4,125,199 | 11/1978 | Abels et al. | 414/671 |
| 4,392,773 | 7/1983 | Johannson | 414/667 |
| 4,406,575 | 9/1983 | Gaibler | 414/667 |
| 4,607,997 | 8/1986 | Asano | 414/667 |

FOREIGN PATENT DOCUMENTS

| | | | |
|---|---|---|---|
| 0759310 | 5/1967 | Canada | 414/667 |
| 2207414 | 2/1989 | United Kingdom | 414/667 |

*Primary Examiner*—Michael S. Huppert
*Assistant Examiner*—James Keenan
*Attorney, Agent, or Firm*—Robert L. Harrington

[57] ABSTRACT

A lifting mechanism for a fork lift truck wherein a side shifting carriage is slidably supported on horizontal bearing bars that are directly attached to the upright of the lift truck. Lifting bars secure the bearing bars together and carry load roller bearings supported in the guide slots of the uprights. A hydraulic motor anchored to the bearing bar assembly at one end and the carriage at the other controls horizontal sliding of the carriage relative to the bearing bars. The interfitting arrangement of the bearing bars in the carriage reduces the load moment arm, reduces the weight requirement, and provides the operator with greater visibility as compared to prior side shift carriage mounts.

6 Claims, 3 Drawing Sheets

LIFT TRUCK CARRIAGE

This is a continuation of copending application Ser. No. 07/691,138 filed on Apr. 24, 1991, now abandoned.

FIELD OF THE INVENTION

This invention relates to lift trucks and more particularly to a carriage and its mounting onto the lift truck which enables the carriage to be side shifted relative to the lift truck. The carriage carries forks that are side shifted with the carriage into position for engaging and lifting a load, e.g. items loaded onto a pallet or other container.

BACKGROUND OF THE INVENTION

Lift trucks are commonly used in warehouses, transfer yards, etc. for handling a variety of items. A large percentage of the items are loaded into containers or on pallets. The lift truck is fitted with forks that are maneuvered by the lift truck operator into receiving pockets provided in the containers or pallets. Controls enable the operator to raise the forks and its load which is then transferred as desired. (Hereafter references to pallets will be understood to be interchangeable with containers otherwise used for carrying or containing items which make up a load.)

Items have to be stored in the warehouse according to the ability of the lift truck to be maneuvered into position for picking up and then transporting the items. For example, aisles have to be wide enough for the lift truck to turn into a stack of loaded pallets. The loaded pallets can't be stacked higher than the reach of the truck, etc. Lift trucks that are compact in configuration with a short turning radius can be maneuvered in smaller spaces which is highly desirable. Also desirable from a maneuverability standpoint is the ability to side shift the forks relative to the lift truck. (This relates to the capability of the forks to be moved laterally relative to the lift truck.) With the side shift capability, a lift truck operator does not have to precisely align the lift truck with the pallet pockets. As he moves in to engage a loaded pallet, if the forks are not aligned with the pallet pockets, he simply engages the side shifting feature. Without this feature, the operator has to move the truck back and forth to obtain the correct alignment.

Prior to this invention, the side shifting feature was typically provided by a double carriage arrangement as follows: Uprights having limited tilting capability are mounted on the front of the truck. The uprights are provided with cooperative vertical guideways for slidably mounting a primary carriage that is raised and lowered relative to the uprights, e.g. by motor driven lifting chains. This primary carriage is designed to receive lifting forks as when the truck lift design does not require the side shift feature. The side shift feature is provided by a sliding carriage. This sliding carriage is similar to the primary carriage and is equipped with clamps that slidingly fit over an upper supporting edge of the primary carriage. Forks are mounted to the sliding carriage and the three desired fork movements are thus provided. The forks are raised and lowered by raising and lowering the primary carriage relative to the uprights. The forks are tilted by tilting the uprights relative to the truck. The forks are side shifted by moving the sliding carriage (via the sliding clamps) relative to the primary carriage.

In this prior device, the primary and sliding carriages are juxtaposed with the sliding clamps mounting the sliding carriage slightly forward of the primary carriage (made necessary by the clamps extended from the sliding carriage and reaching over the top edge of the primary carriage. In comparing the position of the forks mounted to the primary carriage versus their mounting to the sliding carriage, it will be appreciated that the forks on the sliding carriage are spaced substantially further forward from the lift truck. This forward mounting of the forks increases the "load moment arm" (the distance from the load to the center of the front wheels) which is an undesired characteristic of the prior side shift mounting.

SUMMARY OF THE INVENTION

In the preferred embodiment of the present invention, the primary carriage (as a carriage capable of carrying the forks) has been eliminated. The sliding clamps projected from the sliding carriage are modified. Bearing bars replace the primary carriage and are mounted to the lift truck uprights. As will be apparent from the detailed description and drawings, these bearing bars are positioned inwardly from the periphery of the sliding carriage. The sliding carriage is provided with configured, rearwardly extended channels that form tracks and the bearing bars are configured with mating upper and lower edges that fit within the tracks of the carriage. The bearing bars are confined within the depth of the projecting track of the carriage and thus the bearing surfaces are merged into the dimensional thickness of the bearing bar and carriage. This eliminates a substantial portion of the increased "load moment arm" of prior side shift carriages.

The invention and its benefits will be more fully appreciated by reference to the following detailed description and accompanying drawings.

DETAILED DESCRIPTION

Figure 1:
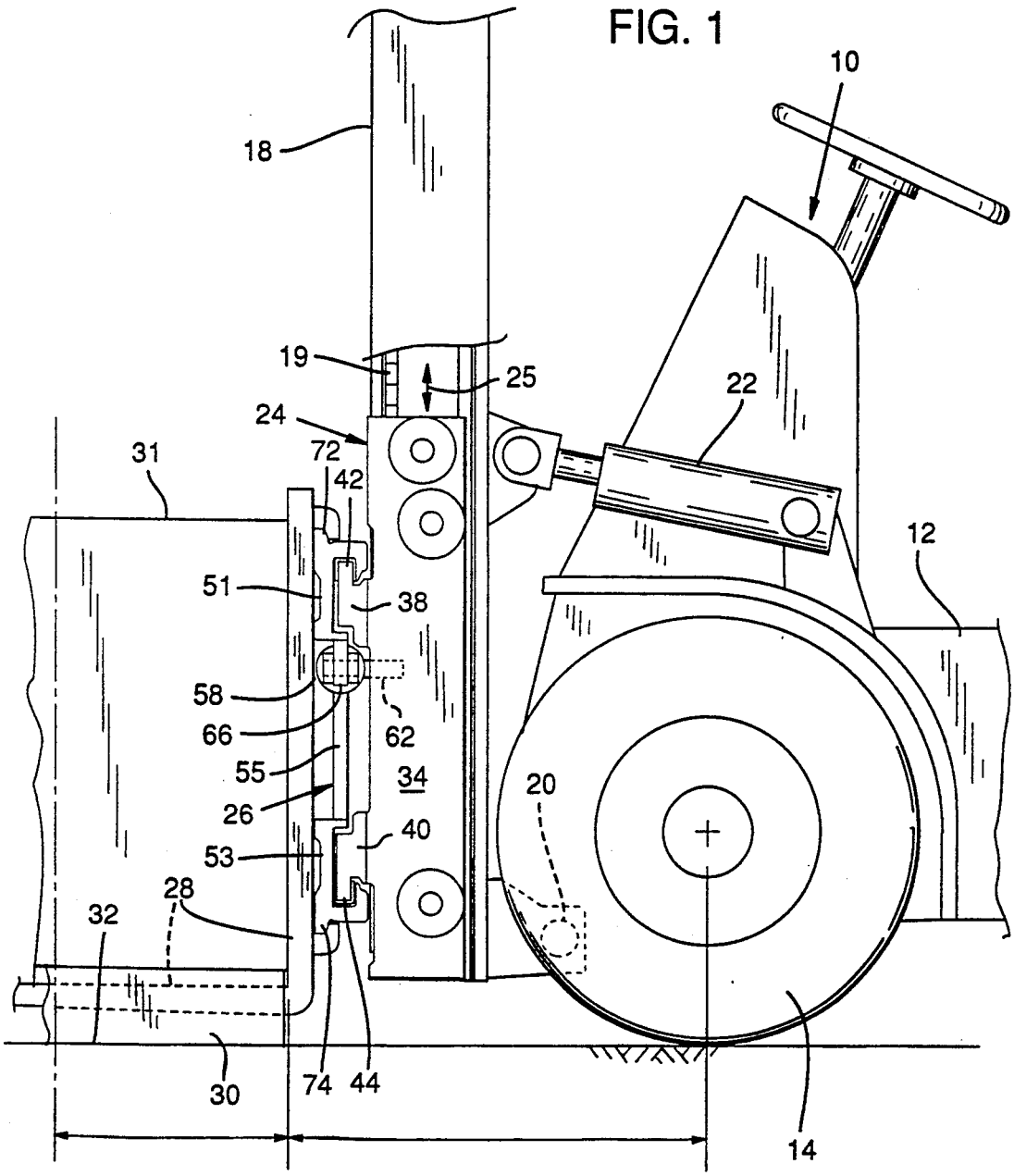
FIG. 1 is a side view of a lift truck including the side shift feature of the present invention.

Reference is made to FIG. 1. A lift truck vehicle 10 includes a body 12, front wheels 14 and rear wheels (not shown). The front or rear wheels are steerable for maneuvering the lift truck 10 down aisles and around tight corners. Uprights 18 are pivotally mounted at pivots 20 to the lower front end of the body 12. A hydraulic motor 22 is attached to the upper end of the uprights and to the body 12 to control the tilting action of the uprights 18 about pivot 20.

The above components are all standard for lift trucks and will not be further described. Continuing with a general description of the components of the invention as illustrated in FIG. 1, a bearing assembly 24 (to be described in detail hereafter) is mounted to the uprights 18 for vertical, slidable movement relative thereto as indicated by the arrow 25. A lifting chain 19 attached to the bearing assembly 24 raises and lowers the assembly relative to the uprights 18. A carriage 26 is horizontally-slidably mounted to the bearing assembly 24 (see also FIG. 2). A hydraulic motor (58, 60) controls the side shifting position of the carriage. Forks 28 are attached to the carriage 26. The forks 28 are illustrated projected into the pockets of a pallet 30 having a load 31 mounted thereon.

In operation, e.g. for engaging and lifting a loaded pallet (30, 31) to be moved to a different location, e.g. onto or off of a truck, the loaded pallet rests on the floor and the lift truck is maneuvered to a position generally lined up with the front of the loaded pallet. The hydraulic motor 22 is engaged to tilt the uprights 18 and thus the forks 28 to a level position. The lifting chain 19 is activated to lower the forks 28 to the level of the pallet 30, i.e. to the floor, and the carriage 26 is side shifted relative to the bearing assembly 24 to align the forks with the pallet pockets. The truck is then driven forward to insert the forks into the pallet pockets as illustrated in FIG. 1. The tilt motor 22 is activated to tilt the loaded pallet back against the fork backs and the lifting chain 19 is engaged to raise the forks and the loaded pallet. The load and pallet 30, 31 can then be transported as desired.

Figure 2:
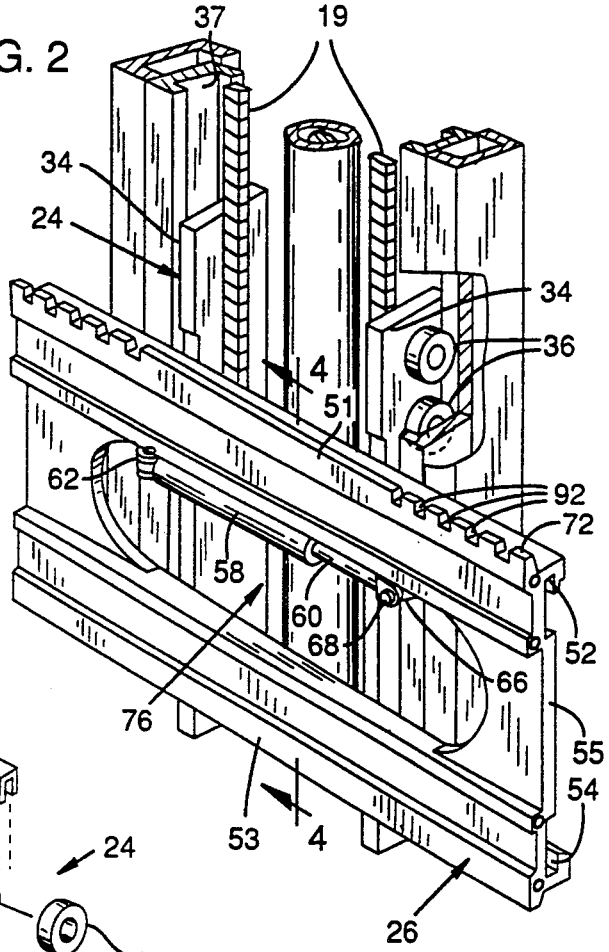
FIG. 2 is a perspective front view of the carriage of FIG. 1 with portions broken away to illustrate the mounting of the side shift components.
Figure 3:
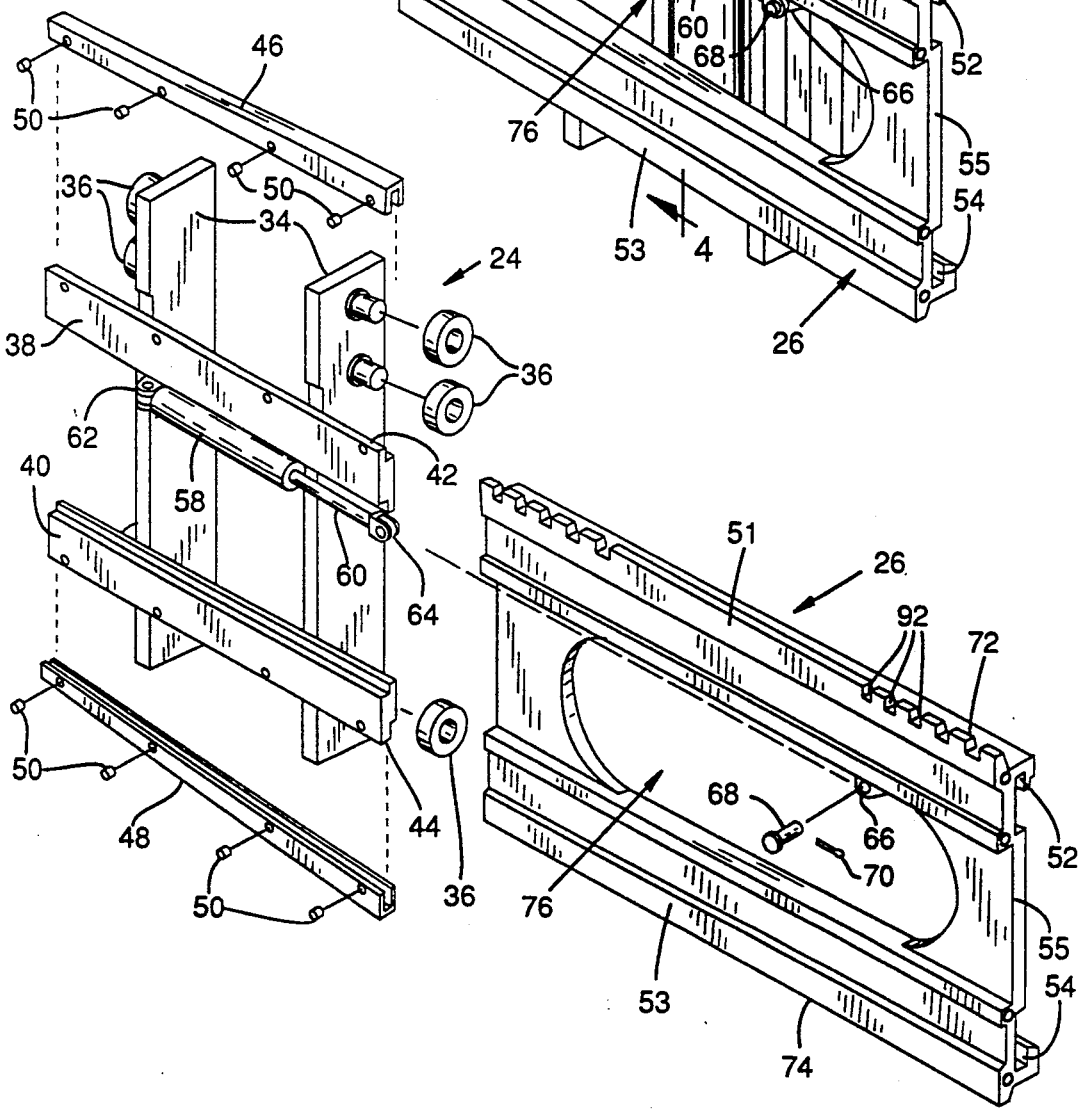
FIG. 3 is an exploded view of these components.

Reference is now made to FIG. 3 which illustrates the bearing assembly 24 and carriage 26 in exploded view. The bearing assembly 24 includes a pair of vertical lifting bars 34 provided with side mounted roller bearings 36. It will be appreciated that similar bearings 36 are provided on the hidden side of the left lifting bar 34. The roller bearings 36 are entrained in channels 37 in the uprights 18 as illustrated in FIG. 2.

Figure 4:
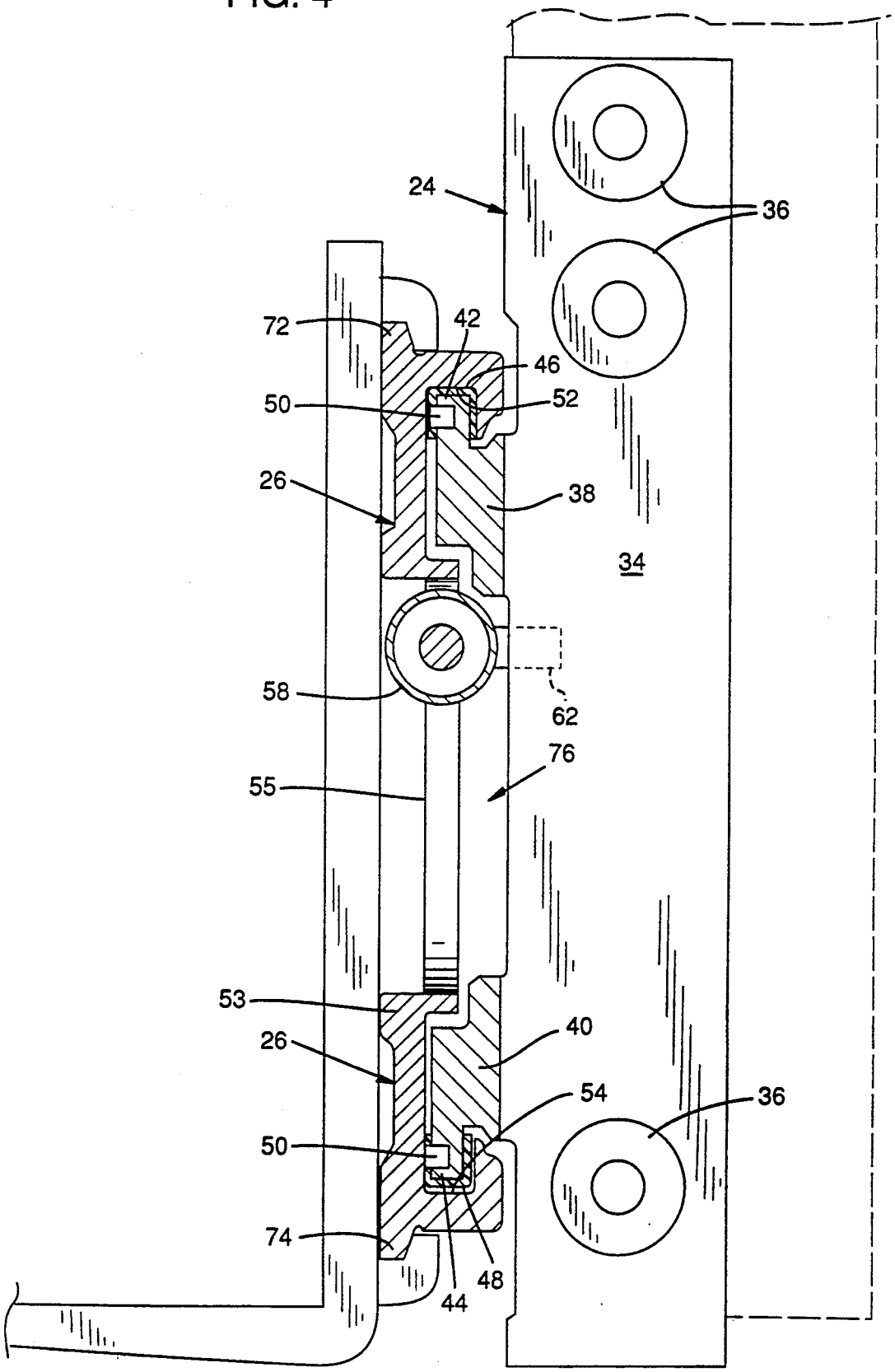
FIG. 4 is a section view as taken on view lines 4—4 of FIG. 2.

With continued reference to FIGS. 3 and 4, a pair of horizontal bearing bars 38, 40 are fixed (as by welding) to the front edges of the lifting bars 34. The upper edge 42 of the top bar 38 and the lower edge 44 of the bottom bar 40 are configured to accommodate slide channels 46, 48 respectively. The slide channels 46, 48 are made of a low friction material, e.g. nylatron and provide bearing surfaces for sliding engagement of the carriage 26. The slide channels 46, 48 are attached to the edges 42, 44 with nylon dowels 50.

The carriage 26 is provided with configured upper and lower tracks 52, 54 of upper and lower carriage bars 51, 53, respectively that receive the slide channels affixed to edges 42, 44 of the bearing bars 38, 40 as illustrated in FIG. 4. In other respects carriage 26 is typical of side shifting carriages for lift trucks. Interconnecting web portions 55 interconnect carriage bars 51, 53 and the carriage bars have a mass that provides rigidity and strength to support the load bearing forks when the carriage is suspended past the ends of the bearing bars. (It will be particularly noted from FIG. 3 that carriage 26 is substantially longer than bearing bars 38 and 40 and the ends of the carriage are suspended past the ends of the bars even when centered. Side shifting of the carriage whereby a load carried on the end of the carriage extends well past the bearing bars demands such strength of the carriage bars.) A motor comprised of a hydraulically actuated cylinder 58 and piston 60 controls the side shifting of the carriage 26 on the bearing bars 38, 40. The cylinder 58 is mounted at 62 to the bearing assembly 24 and the piston 60 at end 64 is mounted to the carriage at mounting lug 66 with pin 68 and cotter key 70.

Upper and lower edges 72, 74 of the carriage 26 are configured in the conventional manner to receive and secure conventional fork tines 28. The fork tines 28 are illustrated in FIG. 1 as mounted to the carriage 26 but otherwise will not be described as they are well known to the art.

The reader's attention is directed to FIG. 2 and to note the location of the cylinder 58 and piston 60 relative to the window 76 that extends through the carriage and which provides viewing of the fork tines 28 from the position of the operator seated at the controls of the lift truck. More particularly, the reader is directed to FIG. 4 and to note that the bearing bars 38, 40 are substantially nested in the tracks 52, 54 formed on the carriage edges. This overlapping or enveloping of the bars and carriage components provides bearing surfaces that are incorporated into the dimensional thickness of the combined components. More importantly, the cumulative overall dimension from the back of the forks to the front of the uprights is substantially no more than the total of the thickness dimensions required of the carriage and bearing bars exclusive of the interacting bearing portions (the tracks 52, 54 and rails/channels 46, 48).

The invention is believed particularly applicable to fork lift trucks where the side shifting feature is considered most beneficial. However, the concept is applicable to other types of lifting trucks, as well. Accordingly, the invention is not limited to the specific embodiment illustrated but extends to apparatus as may be defined by the claims appended hereto.

We claim:

1. In a lifting truck for lifting and moving heavy items, said lifting truck including power means for raising and lowering a lifting mechanism, and a pair of uprights for guiding the lifting mechanism in a vertical path, said lifting mechanism comprising;

horizontally disposed upper and lower bearing bars having front and back sides and top and bottom edges, and guide means secured to the back side of said bearing bars and mounted to said uprights for mounting and guiding the upper and lower bearing bars on the lifting truck uprights immediately adjacent to and forward of the uprights;

a carriage including upper and lower horizontally disposed carriage bars and vertically disposed interconnecting web portions therebetween, said carriage constructed to have sufficient strength and rigidity to support the load of said heavy items, said upper and lower carriage bars configured to have body portions adjacent to and forward of the front sides of the upper and lower bearing bars respectively, and top and bottom flanges that extend over the top edges and under the bottom edges of the upper and lower bearing bars respectively, said top edge of said upper bearing bar and said bottom edge of said lower bearing bar configured to form rails, and said top flange of said upper carriage bar and said bottom flange of said lower carriage bar configured to form tracks that substantially envelope said rails, said carriage adapted to shift relative to said uprights with the carriage bars sliding along said bearing bars whereby the tracks and rails provide the bearing surfaces, said configured carriage bars providing a nesting relationship with said bearing bars for maintaining sufficient strength and rigidity to support heavy loads, and whereby the combined front-to-back spacing of the carriage bars and bearing bars forward of the uprights is substantially the same as that of the carriage bars alone, and said upper bearing and carriage bars are vertically spaced from said lower bearing and carriage bars to provide a viewing window for the fork lift operator; and motor means connected between the bearing bars and the carriage for controlled side shifting of the carriage relative to the bearing bars.

2. A lifting mechanism as defined in claim 1 wherein said guide means comprises a pair of spaced apart vertically disposed lifting bars, said uprights having elongated guide slots and said lifting bars including guide members projected into the guide slots for guided movement of the lifting bars along the length of the uprights;

said lifting bars having portions protruded forward of a forward edge of the uprights and said bearing bars attached to said protruded portions to be raised and lowered along the forward edge of the uprights; and powered lifting means for raising and lowering the lifting bars, bearing bars, and carriage relative to the uprights.

3. A lifting mechanism as defined in claim 2 wherein a pair of forks are removably and adjustably secured to the carriage.

4. A lifting mechanism as defined in claim 3 wherein the carriage is provided with a window opening between the carriage bars through which an operator of the lift truck can observe the forks.

5. A lifting mechanism as defined in claim 4 wherein a top edge is defined by said window opening and the motor means is a hydraulic motor disposed adjacent the upper bearing bar, said motor connected between a lifting bar and the carriage and located at the top edge of the window of the carriage and substantially out of the view of the operator viewing the forks.

6. A lifting mechanism as defined in claim 1 wherein a low friction channel member is positioned between the configured edges of the bearing bars and the tracks of the carriage.

* * * * *